United States Patent [19]

Dunn

[11] 4,143,492

[45] Mar. 13, 1979

[54] CONTROLLED SUN-LIT PLANT HOUSE

[76] Inventor: Mervin E. Dunn, Pimpala Rd., Reynella, Australia, 5162

[21] Appl. No.: 827,666

[22] Filed: Aug. 25, 1977

[51] Int. Cl.[2] ..... E04B 7/12; A01G 9/14; A01G 9/24

[52] U.S. Cl. ..... 52/18; 47/17; 52/200

[58] Field of Search ..... 52/18, 200; 47/17, DIG. 6

[56] References Cited

U.S. PATENT DOCUMENTS

| | | | |
|---|---|---|---|
| 870,917 | 11/1907 | Weston | 52/18 X |
| 2,639,550 | 5/1953 | McKee | 52/18 X |

FOREIGN PATENT DOCUMENTS

| | | | |
|---|---|---|---|
| 434230 | 9/1926 | Fed. Rep. of Germany | 52/18 |
| 1302594 | 7/1962 | France | 52/18 |
| 835292 | 5/1960 | United Kingdom | 52/18 |
| 1203163 | 8/1970 | United Kingdom | 47/17 |

*Primary Examiner*—Alfred C. Perham

*Attorney, Agent, or Firm*—McNenny, Pearne, Gordon, Gail, Dickinson & Schiller

[57] ABSTRACT

A glass house or plant house having the roof and walls of sawtooth configuration, the roof having generally vertical glass areas facing the equator, and sloping opaque sections inclined to the horizontal equal to the rays of the mid-day winter sun. The walls have generally vertical glass panels sloping outwardly at the top and jointed by horizontal opaque sections to allow penetration of the morning and evening sun but decreasing amounts of the day time sun.

9 Claims, 7 Drawing Figures

CONTROLLED SUN-LIT PLANT HOUSE

This invention relates to a controlled sun-lit plant house and like structures.

BACKGROUND OF THE INVENTION

It is general practice when building sun-lit plant houses, commonly termed glass houses, to simply construct a frame which carries a series of glass panes and it accepts light generally from all directions, and control of the amount of light reaching the internal of such a glass house being then purely by artificial shade means applied at the time they are required by the owner.

It is also known to construct such shade houses of wooden slats or to use slats to protect against too much sunlight passing through the glass.

The objects of the present invention are to provide an improved form of plant house which will have an effect such that the amount of sunlight admitted into the structure will be governed by the position of the sun in summer and in winter, whereby the required conditions in the plant house will be automatically adjusted according to the position of the sun in summer and winter.

SUMMARY OF THE INVENTION

Thus according to the present invention a glass house or the like can be designed so as to automatically admit a predetermined amount of sunlight on each day of the year, the design of course varying according to the distance south or north of the equator.

A design which is described herein is particularly suitable for the southern states of Australia but naturally the invention can also apply in other areas provided the shape of the structure is calculated in relation to the angle of the sun. This determines the positioning of the glass or other members which let sunlight in at the required times.

DESCRIPTION OF THE PREFERRED EMBODIMENT

Figure 1:
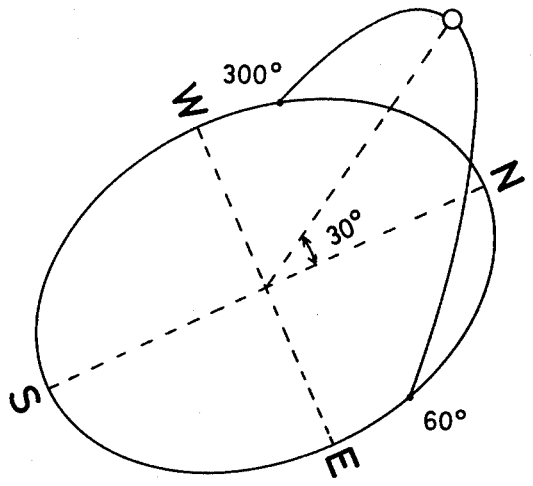
FIG. 1, shows diagrammatically the path of the sun in southern Australia during mid-winter.
Figure 2:
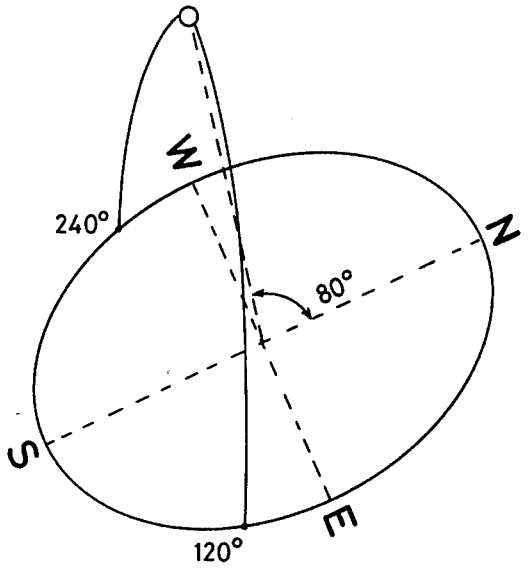
FIG. 2 shows diagrammatically the path of the sun in southern Australia during mid-summer.
Figure 3:
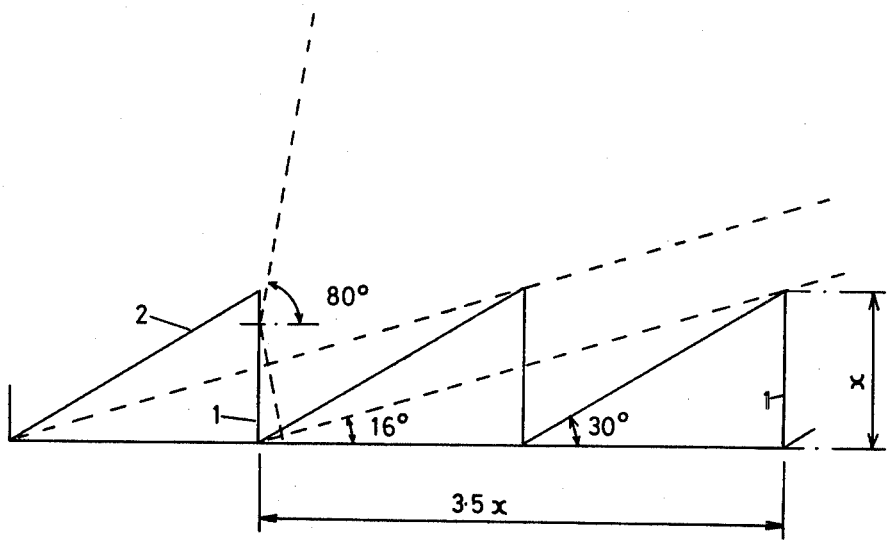
FIG. 3 shows diagrammatically the roof of the glass house.

It will be realised that in the southern part of Australia the greatest source of winter sunlight is from a low angle in the northern sky as shown in FIG. 1 where the maximum angle of the sun at noon is 30°, and it follows therefore that the northern wall of the plant house should be composed entirely of glass to take advantage of this low angle light in the winter. The area of the plant house, to benefit from light admitted through the northern glass wall will depend on firstly the length of the northern wall, secondly the height of the wall and thirdly the width of the plant house in an east-west direction. If the plant house is not more than three and one half times wider in the north-south direction than the height of the north wall, sunlight will flood the floor of the plant house through the north wall at all times that the sun is under 16° but to obtain the maximum penetration of sunlight at this time of the year without increasing the height of the northern wall, sunlight should enter the plant house through the roof when the sun is above the 16° altitude and it therefore should enter through the roof through vertical or near vertical glass in the generally east-west plane facing approximately true north.

If the angle now made between the top of one row of vertical glass and the bottom of the next row is thirty degrees, this will coincide with the sun's maximum altitude in mid winter when its daily ground level radiation is least.

It follows that this sloping surface 2 in the roof will not effect the mid winter noon-day sunlight admitted to the plant house and therefore it can be of an opaque, insulating material such as asbestos cement sheet.

At mid winter, the plant house with the northern glass vertical wall, and vertical glass in the roof facing north, and opaque material between the rows of glass in the roof at 30° pitch will admit almost ninety percent of the solar radiation for the day which is considerably more than a conventional glass house which loses a proportion (25%) of the radiation by reflection of the sun's rays from the glass roof.

In mid summer, with the same design, the northern glass wall if it is of vertical sheets of glass, will admit the maximum of but fifty percent of the sun's radiation and this only when the sun is at its maximum altitude of about 80° at about Noon when its azimuth is true North.

This sunlight through the northern wall will cover a small area of the plant house floor along the North wall.

Sunlight, reduced to fifty percent intensity by reflection of the glass, will also enter the plant house through the vertical glass in the roof.

The bands of sunlight will be about one fifth as wide as the height of the roof glass at centres one and two thirds times the height of the glass.

During the day these bands of sunlight will move North and South across the floor of the plant house at least the distance apart of their centres, provided the roof is at least eight feet from the floor and the centres not more than eighteen inches apart.

Such light is estimated to be the equal of winter light. As the sun moves from its summer path to its winter path several important changes occur.

1. The intensity of radiation decreases.
2. The sun moves further into the Northern sky.
3. Wider bands of light are admitted.
4. The percentage of radiation transmitted through the glass increases.

The latter three compensate for the former to give a reasonably constant light intensity throughout the year.

In practice, slightly higher intensities of radiation are admitted at both the equinox which compares with the increased radiation at the equator at these times of the year to which tropical plants are accustomed.

By altering the angle of the roof glass from vertical to an incline at the top of 15° to the South, seventy percent of the mid summer sun's radiation is admitted.

This arrangement will provide a light intensity ranging from full winter sunlight up to seventy percent of summer daylight.

The alteration is made simply by increasing the centres between the rows of glass in the roof to twice the height of the glass.

An eight percent slope in the glass will give fifty percent of summer light and hence any variation from full winter sunlight increasing up to seventy percent of summer light can be provided for in the design of the plant house.

The amount and the intensity of the solar radiation admitted to the plant house through the east-west and north walls can conveniently be controlled by fixing the panes of glass in these walls inclined outwards at the top.

Figure 4:
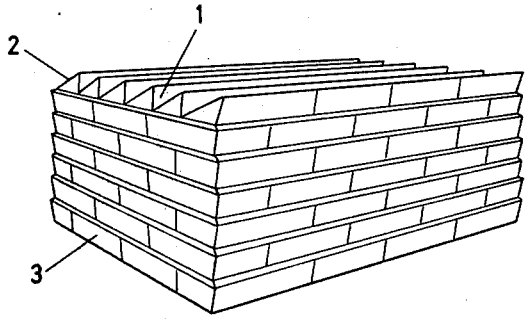
FIG. 4 shows a perspective view of a glass house.
Figure 6:
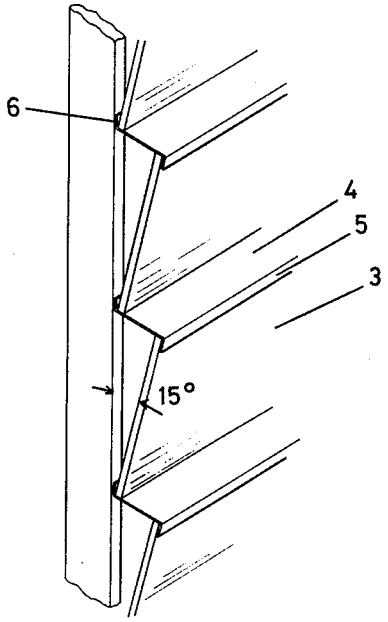
FIG. 6 shows the details of a wall of the glass house, and, FIG. 7 shows a construction of the roof according to the invention.

For example, the glass 3 in the east wall fixed at Normal minus 15° (top edge 15° east of vertical) on 22 December and thereabouts, (see FIGS. 4 and 6) is normal to the solar radiation from apparent sunrise until the apparent solar altitude reaches 30° at about 0830 hours solar time at 35° latitude from this time until about 1100 hours the increase in the intensity of the solar radiation is offset by the increasing non-normality of the glass as the sun's altitude increases. At about 1100 hours all direct solar radiation is excluded from the plant house through the east wall by the opaque material 4 fixing the top edge of the glass to the structure of the plant house.

It has been found that in areas where very high summer temperatures are common, that in order to minimise the penetration of the sun's rays in the high temperature periods of the summers day which occur in the vicinity of 1400 to 1500 hours, that the sawtooth roof, instead of facing true north, can ideally be faced at 20° east of north.

In this way, in effect, the maximum solar radiation admitted for the day occurs at 1000 hours, and due to the slight angling of the roof from true north there is a lesser amount of penetration of the sun's rays during the hottest period of the day.

The structure may be so orientated, or alternatively either the whole or part of the roof may be angled in relation to the structure itself. Hence a portion of the roof may be angled to the east, while the remainder may be angled to the west so that depending upon the variety of the plants to be grown adequate control may be obtained by appropriately positioning the plants in the plant house.

The glass is conveniently fixed in the east-north and west wall by securing in a horizontal or near horizontal plane strips of material 4 such as galvanised iron, aluminium, plastic or other to the vertical structure of the plant house.

The outer edge 5 of the material 4 may be bent at about a 75° interval angle to hold the top edge of the glass 3 and the inner edge 6 is then bent at about right angles to hold the bottom edge of the glass 3 and fix the material 4 to the plant house structure.

Panes of glass 3 are placed between the opaque material 4 with one edge of each pane abutting the next pane and the other edge overlapped slightly thus allowing easy sliding of the glass to ventilate the plant house.

As during the summer months, the sun path is changed considerably, and ground level radiation is more intense due to the rays more direct path through the atmosphere, the structure is so arranged that the sunlight enters the plant house through the vertical glass 1 of the roof, starting with a very narrow band of light but reaching a maximum at about noon when the sun is true North.

At this stage the bands of light are very narrow and as reflection from the glass also reduces the amount of sun radiation which can enter the structure the required amount of illumination can be obtained.

The amount of light entering the house will be determined also by the angle of the near vertical glass in the roof.

To obtain an even intensity of light throughout the whole plant house in summer, the south wall may also be formed of glass and it is to be noted that sunlight will enter the south wall in summer in the early mornings and late evenings and only when the rays do not possess the same quality of the near noon radiation. The acute angle that these rays strike the southern vertical glass cause a proportion to be reflected, again further reducing the radiation admitted to the plant house.

So far as the roof is concerned the amount of light which can issue at the appropriate times can readily be selected by varying the distance between rows of vertical glass panes in the roof, and the greater the distance between these the less light will be admitted in the summer when the sun is relatively higher overhead. As said, the angle of the glass is also important in varying the sunlight admission.

Figure 5:
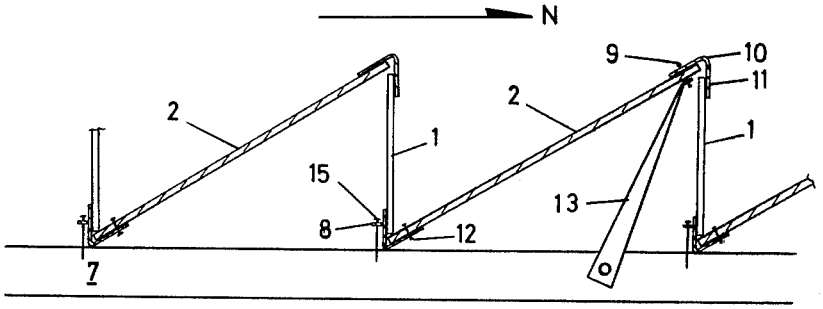
FIG. 5 shows the constructional details of the roof.

The structure of the roof can be varied but according to a convenient arrangement as illustrated in FIG. 5, rafters 7 are provided which extend across from the northern to the southern walls and on these rafters are fitted a series of gutters 8 which will be spaced apart a required distance to control the spacing of the glass in the sawtooth roof and these gutters 8 are arranged to support asbestos or similar sheets 2 which can be positioned at an angle of approximately 30° and have their lower edge projecting into one of the gutters 8 and their upper edges pop rivetted 9 or otherwise affixed to a ridge cap 10 which projects downwardly 11 to form the support of the upper edge of the glass 1 which is to be the light admission means.

The asbestos or other sheets 2 are preferably rivetted to the gutters 8 by pop rivets or gutter bolts 12 passing through the same just inside of the edge of the gutter 8 while the higher edges of these sheets 2 which join to the ridge cap 10 can be held down by straps 13 at appropriate positions, preferably by the pop rivet 9 passing through the ridge cap 10, sheet 2 and strap 13. A stop 15 can be used to retain the gutters 8 in position.

As these opaque members such as strips of asbestos 2 rest in the gutters 8, it is possible to so select the gutters 8 that just sufficient space will be left between the edges of these sheets 2 and the further edge of each gutter 8 that a pane of glass 1 can be stood into the gutter at this locality, the glass projecting upwardly and as previously described, engaging the ridge cap 10 of the adjacent sloping asbestos or similar sheet 2 to form the sawtooth roof.

A convenient size is to use sheets 2 having a width of one foot six inches and to use glass 1 having a height of approximately nine inches but naturally these proportions will vary according to the latitide at which the building is erected and the amount of light which is to be admitted for the particular purpose.

While asbestos is a suitable material to use for the opaque sections of the sawtooth roof and glass is suitable for the light admitting portions, it is obvious that other forms of material can be used, but naturally the type of material used will govern the temperature within the structure and it is therefore desirable that the light shading areas should be of a nature such that they can transmit as little heat as possible so that the effectiveness of the glass section is greater in controlling the temperature as obviously if the non-transparent sections are relatively heat resistant, then the control will be more by the amount of light admitted through the glass which of course then controls the temperature strictly in relation to the position of the sun at the particular time of the year.

Preferably each of the four walls are constructed similarly to the above-described east wall, so that by sliding the glass panes in the walls over each other ventilation can easily be controlled. If need be, these glass panes can be readily removed for more complete ventilation.

In most instances it is virtually essential that the northern wall or the wall facing the equator be constructed in the above manner for the reasons previously given.

Figure 7:
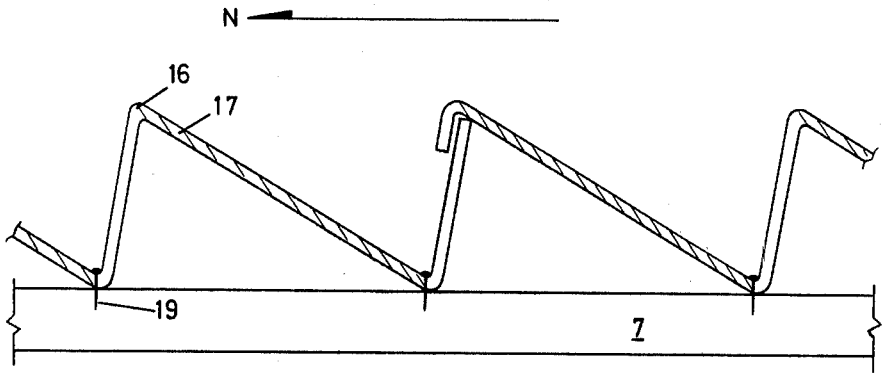

FIG. 7 shows a construction of the roof according to the invention. In this embodiment the roofing material can be moulded or otherwise formed from a plastics material such as PVC or PVA or similar material.

The roofing material 16 is formed with sloping opaque portions 17 and vertical or near vertical clear portions 18. In one convenient form the vertical clear portions could be 3" in height, the sloping portions 6" in length, thus giving the required angle of slope of 30°. Attachment to the rafters or battens could be by simple fasteners such as nails, or screws 19 to fasten the sheets in a similar fashion to corrugated roofing material.

One preferred form of cladding material can be of fibre glass reinforced plastics material. These sheets of fibre glass reinforced plastics material can have a profile of sawtooth formation, i.e., upstanding verticals joined by sloping portions from the top of one vertical to the base of the next adjacent vertical, all the sloping portions being parallel. For use as a roofing material the verticals are made transparent while the sloping portions are made opaque, semi-transparent or reflecting material. The verticals for a latitude of about 35° South may have a height of about 1½° and spaced at 3° giving tan 0.5=26½°, or alternatively, as noted above, the respective figures could be 1" and 2" thus giving a slope of the inclined portion of about 26½°-33°. Thus as the noonday sun in winter at this latitude has an angle of about 30°, then the maximum penetration of heat and light is available most of the day.

Hence in mid-winter the planthouse with the vertical portions in the roof facing North, and if the northern wall of the planthouse is of transparent material up to about 90° of the solar radiation will be admitted, which is considerably more than the conventional planthouse which loses a large proportion of the radiation by reflection of the sun's rays from the roof by striking the roof at an acute angle.

The cladding material thus takes into account the following points, the sun's changing path in the sky throughout the year, the consequent variation in the intensity of radiation that reaches ground level and the solar radiation transmission co-efficient of the transparent material.

The sloping portions of the material may be opaque with a suitable pigment applied to the surface of the material such as by the application of a "gell" coating, alternatively either threaded or woven aluminium strip or thread may be incorporated with fibre glass reinforced plastic material along the sloping portions, or if desired other opaque reflecting material may be incorporated.

In an alternative embodiment the material may be clear polyvinyl chloride in sheet form and the opaque material may be incorporated on, in or under the sheet. This opaque material may be aluminium sheet foil or film 0.001" in thickness and may be applied by metallising, extrusion coating or by calendering. However, these are not the only materials that can be used to give the same or similar results.

The choice of clear or transparent material and the choice of the opaque or semi-transparent material is of any two materials with these characteristics or one material which can be formed into the one sheet to give differing radiation transmission co-efficients in differing parts of the sheet.

To obtain a reasonably constant average light intensity per square foot of floor area of the planthouse throughout the year at about latitude 35° South, the profile as described above may be used fixed in a horizontal plane. Varying summer/winter intensities may be obtained by fixing the same material out of horizontal. Also the same profile can be used in near latitudes to give the same result by fixing out of horizontal.

On December 22nd and thereabouts when the sun's altitude is 78° and its azimuth is 000° if the clear faces face true North, the maximum solar radiation is reduced approximately 50° in intensity, according to the transmission co-efficient of the material and the fact that the radiation strikes the faces of the material at an acute angle, portion will be reflected from the clear faces and the remainder will be transmitted through the sheet in narrow bands at centres the distance apart of the vertical sections and this is the maximum transmission through the sheet on this day of the year.

These bands of light will move South and North again as the sun's apparent movement is from East to North to West, and the distance the bands of light move and their speed of travel over the floor of the planthouse will be determined by the distance the sheet is fixed from the floor. At 8'0" above floor level the bands will move approximately 2' and back again on December 22nd. This is the minimum movement for the year. Diffusion of the solar radiation by the material causes an even intensity over the whole floor area.

On June 21st and thereabouts when the sun's apparent path is sunrise azimuth approximately 060° and sunset 300°, its maximum altitude will be 31½° at Noon Solar Time when its azimuth is 000° the proportion of the radiation transmitted through the material will be at the maximum, the rays being practically normal to the clear faces.

As the sun's apparent path alters from summer to winter a reasonably constant transmission of radiation is admitted to the planthouse by wider bands of light being admitted and an increasing proportion of the weakening radiation being transmitted through the material. The reverse applies from winter to summer.

To modify the intensity and thereby the amount of radiation admitted through the walls of the planthouse particularly the northern wall and also the East and West walls if desired, the opaque part of the same profile material is included in the 1½ section and the clear material in the 3" section, that is the verticals have the opaque material and the sloping portions are clear. For use on the walls the sheets of material are then fixed to the wall structure with the opaque material in the horizontal plane and the sloping portions sloping upwardly and outwardly from the wall. In this way, due to the low altitude of the sun, the material will not materially alter the solar radiation admitted to the planthouse in the winter, but will reduce the solar radiation admitted in summer, particularly it will exclude a big proporation of the late morning, noon and early afternoon radiation that is often of such an intensity to cause damage to the plants during the summer months.

For higher latitudes than 35° the angle of 60° between the clear and opaque portion of the material should be increased slightly to give similar results and for lower latitudes that angle should be decreased, or the material can be fixed in a position out of horizontal.

For latitudes within the Tropic of Cancer and Capricorn the opaque material should be replaced with semi-transparent material to give greater transmission when the sun reaches a position overhead and further from its median path. If the roofing structure is such that there is a small incline towards the North, this will reduce the summer transmission again without altering that of the winter transmission.

By fixing the material so that the transparent surfaces face up to 30° East of North to the maximum intensity of solar radiation admitted to the planthouse is moved in time from noon towards sunrise, and the reverse applies by facing the same section West of North.

For high summer transmissions the East side of the roof transparent surfaces can be fixed at say 20° East of North and the West side may be fixed at 20° West of North.

The same and similar profiles will give similar solar radiation transmission benefits through material fixed on buildings for purposes other than the culture of plants, for example, Hotel Beer Gardens, Houses or Buildings for animal husbandry, Playgrounds, Sports Grounds, Patios, Porches, Sunrooms and Swimming Pool enclosures.

The profiles and sheet material hereindescribed can be easily fixed as by nailing through the sheet material on the high side of the verticals in similar manner to which conventional roofing material is fixed or fixing with waterproof screws or nails in the bottom of the profiles.

It will be seen that the sawtooth configuration is relatively small in relation to the building, this being compared with conventional sawtooth buildings, such as are known in the industrial field for factories and the like.

The relative small configuration is important so that only narrow bands of shadow occur as the sun proceeds across the sky, to cause the narrow bands of shadow to pass across the area inside the plant house. This gives more uniform temperature control not only throughout the whole plant house, but also in individual areas, for each individual area is not exposed to a large period of sunlight and then a long period of shadow. Thus more uniform heating is available, not only within the structure but that there is little variation throughout the year due to the different inclinations of the sun's rays.

Although the above described preferred embodiments are directed primarily to glass houses, it is to be realised that the invention is not to be limited thereto but is intended to include not only glass houses but stock sheds and buildings for animal husbandry, poultry, sheds, verandahs, patios, covered walk-ways, beer gardens and the like.

As stated earlier, the design of the structure will vary according to locality and with a change in latitude therefore the ratios of glass to opaque sections and also the angles of these members will vary but calculations can readily be carried out according to the particular latitude and the known temperatures which are aimed at, to decide on the ratio and angle of the light transmitting section in relation to the light shading sections.

We claim:

1. A controlled sun-lit structure including supporting walls and a roof, the roof comprising alternate portions of clear material and opaque material in sawtooth configuration, the clear material on the roof being generally vertical and facing the equator with the opaque material being inclined to the horizontal at an angle generally equal to the inclination of the rays of the mid-day mid-winter sun, the surface area of the clear material in the roof relative to the internal surface area of the structure being such that the area of sunlight projected internally of the structure at higher inclinations of the sun's rays is reduced duriing the summer months and increased during the winter months.

2. A structure as defined in claim 1 wherein the roof is supported on rafters running in the north-south direction, and includes gutters spanning the rafters, the clear material comprising glass sheets and the opaque material resting in the gutters and being united at their upper and lower edges.

3. A controlled sun-lit structure including supporting walls and a roof, the roof comprising alternate portions of clear material and opaque material in sawtooth configuration, the clear material on the roof being generally vertical and facing the equator with the opaque material being inclined to the horizontal at an angle generally equal to the inclination of the rays of the mid-day mid-winter sun, the surface area of the clear material in the roof relative to the internal surface area of the structure being such that the area of sunlight projected internally of the structure at higher inclinations of the sun's rays is reduced during the summer months and increased during the winter months, the walls comprising glass panes arranged generally vertically but being inclined outwardly at their upper edges, the space between the top of one pane and the lower edge of the next upper pane being closed with a generally horizontal sheet of opaque material.

4. A structure as defined in claim 3 wherein the opaque material is attached to the wall studs, the edge of the material adjacent the wall studs being formed to support the lower edges of the glass panes and its outer edges bent to support the upper edge of the glass panes situated immediately below the above defined glass panes, and wherein the glass panes rest in their respective supports in abutting relationship and are able to slide over each other for ventilation purposes.

5. A roofing material for a controlled sun-lit structure including supporting walls and a roof, the roof comprising alternate portions of clear material and opaque material in sawtooth configuration, the clear material on the roof being generally vertical and facing the equator with the opaque material being inclined to the horizontal at an angle generally equal to the inclination of the rays of the mid-day mid-winter sun, the surface area of the clear material in the roof relative to the internal surface area of the structure being such that the area of sunlight projected internally of the structure at higher inclinations of the sun's rays is reduced to the extent that a substantially constant temperature is maintained in the interior of the structure throughout the year, said roofing material comprising a sheet of plastics material of sawtooth configuration.

6. A controlled sun-lit structure as defined in claim 5 wherein the roofing material is fibre glass reinforced plastics material.

7. A controlled sun-lit structure as defined in claim 5 wherein the opaque surface is provided by a gell coating on the sloping surface.

8. A controlled sun-lit structure as defined in claim 6, wherein the opaque surface is provided by aluminium threads which may be woven into a strip are incorporated with the reinforced plastic material.

9. A controlled sun-lit structure as defined in claim 5 wherein the material is polyvinyl chloride, the opaque material comprising an aluminium film applied either by metallising, extrusion coating or calendering.

* * * * *